US006362444B1

(12) United States Patent
Lee

(10) Patent No.: US 6,362,444 B1
(45) Date of Patent: Mar. 26, 2002

(54) GAS INSULATING SWITCHGEAR

(75) Inventor: Seok Won Lee, Cheongju (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/680,441

(22) Filed: Oct. 6, 2000

(30) Foreign Application Priority Data

Oct. 7, 1999 (KR) ..... 99-43295

(51) Int. Cl.[7] ..... H01H 9/40
(52) U.S. Cl. ..... 218/3; 218/153
(58) Field of Search ..... 218/7, 3, 178–80, 218/154, 153

(56) References Cited

U.S. PATENT DOCUMENTS 3,399,286 A * 8/1968 Kerr, Jr. ..... 218/7
4,538,039 A * 8/1985 Gotoh et al. ..... 218/2
4,814,559 A * 3/1989 Stegmueller ..... 218/154
4,965,419 A * 10/1990 Chyls et al. ..... 218/7
6,121,566 A * 9/2000 Biquez et al. ..... 218/7

* cited by examiner

*Primary Examiner*—Lincoln Donovan

(57) ABSTRACT

A gas insulating switchgear comprising: a first switching unit for connecting or breaking an electric circuit between a power source and a load; a second switching unit being mechanically and electrically connected with the first switching unit and being selectively movable to an electrically conducting position, an electrically breaking position or an electrically grounding position; and an actuator being connected to supply a driving force to the second switching unit so that the second switching unit can be moved. In case that the gas insulating switch gear is applied to a switchgear having a rated insulating breakage voltage level of 125 KV, the switch gear can have a rated breakage insulating voltage of more than 125 KV (150 KV) by using the vacuum interrupter and the second switching unit each having the rated insulating voltage level of about 75 KV. In addition, by adding the earthing function using the ground terminal, a worker can do a job such as a power source or load cable installation, cable maintenance and repairing in a more safe circumstance.

1 Claim, 5 Drawing Sheets

GAS INSULATING SWITCHGEAR

BACKGROUND OF THE INVENTION

1. Field of the Invention

The present invention relates to a gas insulating switchgear, and more particularly, to a gas insulating switchgear which does not require a high insulating strength of a vacuum interrupter within a switchgear while satisfying a whole insulating strength required for the switchgear. More specifically, the present invention relates to a gas insulating switchgear which is capable of reducing a production cost compared to that of a conventional art and of performing installation of a cable towards a power supply or a cable towards a load to be connected with an apparatus of the present invention and its maintenance work under the safe circumstance.

2. Description of the Background Art

Generally, the electricity is generated at about 20,000V in an electric power station, boosted to an ultra-high voltage to be suitable for power transmission and then transmitted to a first substation. Upon receipt of the ultra-high voltage, the first substation drops it to 22.9 KV and supplies it to a second substation or to each customer.

The power supplied from the first substation to the second substation or to each customer is supplied to a power receiving facility of each customer through a distributing system having a terrestrial distribution line or a subterranean distribution line, and supplied to an ultra-high voltage consumer and a high voltage consumer and also supplied even to a low voltage consumer through various outdoor installed transformer.

In order to identify and branch the subterranean distribution lines and protect a first coil of the transformer, a gas insulating switchgear, so called a ring main unit, is used.

For the gas insulating switchgear, a SF6 gas insulating switchgear using SF6 gas as an insulating material is widely used, which includes a manually operated switchgear and a remotely operated switchgear in terms of its operating methods.

For example, a conventional gas insulating switchgear uses a vacuum interrupter which extinguishes arc generated when a switch is on or off by using vacuum having a comparatively good insulating strength.

In case that the arc extinguishing of the switchgear using the vacuum interrupter is applied to a switchgear having a rated insulation breakage voltage of 125 KV, since the arc extinguishing and insulation between contact points are fulfilled within the vacuum interrupter, the rated voltage level of the vacuum interrupter should be more than 125 KV, accordingly.

However, the vacuum interrupter becomes expensive as its rated insulation breakage voltage is higher. Thus, in case of employing a vacuum interrupter of a higher rated insulation breakage voltage, the overall production cost of the switchgear us dependently increased.

In addition, a switching means of the convention switchgear is the only vacuum interrupter having only two switching positions including switch on or switch off, so that, when the cable is installed, maintained and repaired, the switchgear itself is not able to perform ground function of a cable.

Moreover, when the switch is off (the circuit is opened), the distance between a movable contact and a fixed contact is about 10~20 mm. In this respect, in case that a high voltage is generated between the movable contact and the fixed contact (that is, in case that arc is generated), the security of a worker is degraded.

SUMMARY OF THE INVENTION

Therefore, an object of the present invention is to provide a gas insulating switchgear which is capable of satisfying a required high rated insulation breakage while not raising the rated insulation breakage level of a vacuum interupter, to thereby reduce a production cost.

Another object of the present invention is to provide a gas insulating switchgear which is capable of grounding a high-voltage current in the case where a cable towards a power-source or a load is installed, maintained and repaired, to thereby ensure a safe working.

To achieve these and other advantages and in accordance with the purpose of the present invention, as embodied and broadly described herein, there is provided a glass insulating switchgear including: a first switching means for connecting or breaking an electric circuit between a power source and a load; a second switching means being mechanically and electrically connected with the first switching means and being selectively movable to an electrically conducting position, an electrically breaking position or an electrically grounding position; and an actuator being connected for supplying a driving force to the second switching means so that the second switching means can be moved.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
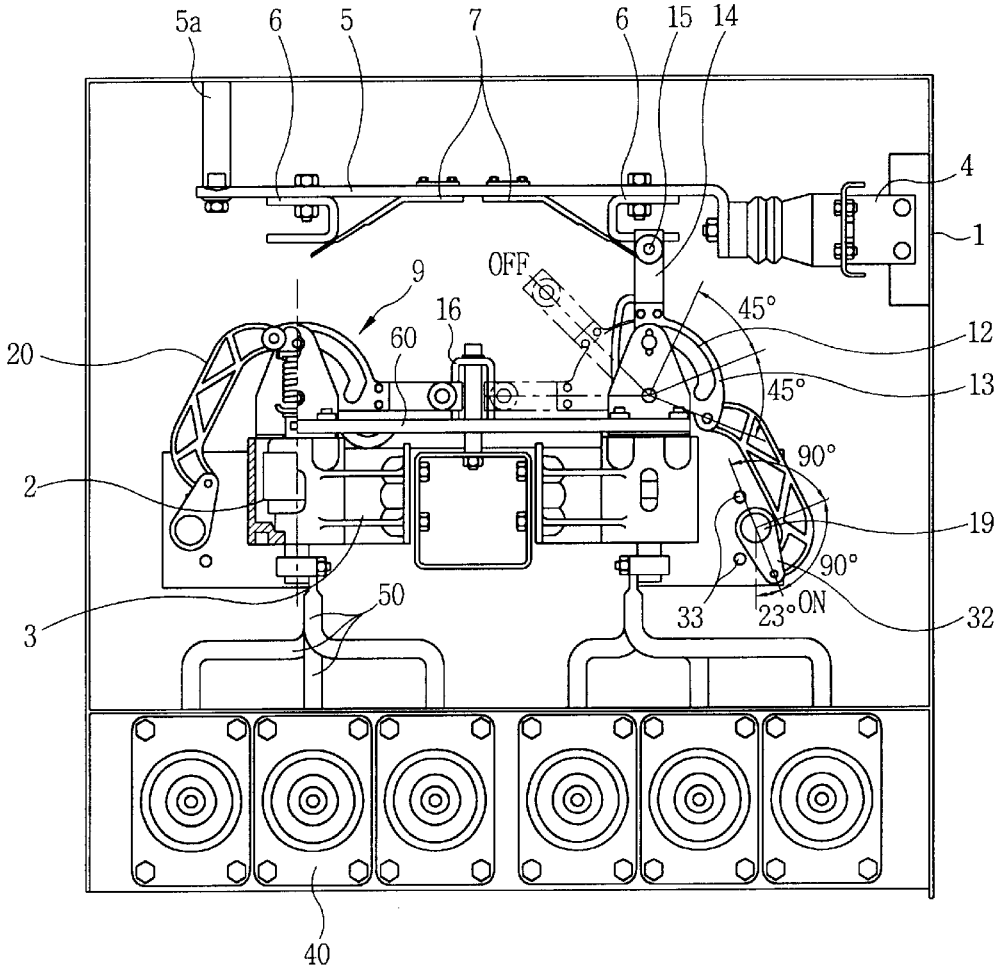
FIG. 1 is a front view of a gas insulating switch gear in accordance with the present invention.

FIG. 1 is a front view of a gas insulating switchgear in accordance with the present invention.

A housing 1 is a container for holding a switchgear according to the invention, which is sealed after being filled with SF6 gas having a high electric insulation.

Reference numeral 2 is a vacuum interrupter, that is, a first switching means, which includes a movable contactor and a fixed contactor in the vacuum having high electric insulation.

An insulating housing 3 is an electric insulating container for holding a vacuum interrupter 2.

A bushing 4 is a power source terminal or a load terminal which has one end exposed outwardly to connect with a power source or a load outside the housing 1 and the other end extended into the housing 1 to connect the switchgear of the present invention. The bushing 4 is fixedly installed on one side wall of the housing 1.

A bus bar 5 includes one end electrically and mechanically connected with the bushing 4 and the other end extended to the other side wall facing the one side wall of the housing 1. The bus bar 5 is supported by a support member 5*a* fixed at the upper wall of the housing 1 made of an insulating material.

There are three bus bars 5 for transmitting three-phase AC currents, but two of which are not illustrated in FIG. 1.

As a second switching means, a pair of fixed contactors 6 are fixed at positions adjacent to the support member 5*a* and the bushing 4 at the lower surface of the bus bar 5 by a fixing member such as a bolt.

A pair of plate springs 7 are fixed by a means such as a rivet or welding at positions adjacent to the central portion of each bus bar 5. The plate springs are the contact force reinforcing means to pressurize the movable contactor toward the direction so as to contact the fixed contactors 6. Unlike the embodiment as shown in FIG. 1, the plate spring 7 made of a conductive material itself can serve as a fixed contactor, without the fixed contactors 6.

The respective movable contactor 9, as the second switching means, is rotatable clockwise or counterclockwise around a pressure pin 11 and has a guide member 13 including a guide aperture 12 for guiding the pressure pin 11 and a blade member 14 coupled with the guide member 13 to be rotatable clockwise or counterclockwise.

The movable contactor 9 includes a switching pin 15 which penetrates the blade member 14 and is rotated by the blade member 14, so that the switching pin 15 may contact the fixed contactor 6 and the plate spring 7, being switched ON, or may be separated from the fixed contactor 6 and the plate spring 7, being switched OFF, or may be positioned to the ground position contacting a ground terminal 16.

Assuming that the angle of the position at which the switching pin 15 contact the fixed contactor 6 is '0' degree, with reference to FIG. 1, the ground terminal 16 is installed to contact the operating pin 15 at a position that the operating pin 15 being right on the FIG. 1 has been rotated by 90° counterclockwise (at a position that the operating pin 15 being left on the FIG. 1 has been rotated by 90° clockwise). The ground terminal 16 is formed in upside-down 'U' shape of conductive member. Electricity passes through a bolt shaped conductive member (no reference numeral is given) penetrating the ground terminal 16 to be extended, a rectangular column 16*a* also made of a conductive material and an external conductor (no shown) coupled with the rectangular column 16*a*, thereby being grounded.

The construction of the movable contactor 8 (referring to FIG. 3) of the vacuum interrupter 2 and the actuator means for providing a driving force to the movable contactor 9 will now be described.

The actuator means includes a single rotatable driving shaft 19; a link means for transmitting a rotational torque of the driving shaft 19 to the movable contactor 9; and a converting means for converting the rotation of the second movable contactor to a linear driving force and providing it to the first movable contactor.

The driving shaft 19 may be manually rotated by being coupled to a handle (not shown) or automatically rotated by being coupled with a driving source, such as a motor.

The converting means includes a movable contactor 9 having the guide aperture 12; a supporter member 10 (referring to FIG. 3), of which one end portion is coupled with the movable contactor 9 and the other end portion is extended towards the guide aperture 12, being linearly moved along with the first movable contactor; and the pressure pin 11 being installed to penetrate the other end portion of the supporter member 10 and the guide aperture 12 and converting the rotational force of the movable contactor 9 to a linear movement force by being pressurized by the guide member 13 having the guide aperture 12 in a vertical direction to thereby support the linear movement force to the supporter member 10.

The link means includes a driving arm 32 being coaxially coupled with the driving shaft 19 so as to be rotatable in the same direction with the rotating direction of the driving shaft 19; and a link 20 of which one end portion is coupled with a free end portion of the driving arm 32 so as to be relatively movable and the other end portion is coupled with the movable contactor 9 so as to be relatively movable.

In order to limit the angle of rotation of the driving arm 32 (preferably, it is limited to 180°), a pair of limit pins 33 are installed at adjacent predetermined portions of the upper or the lower portions of the driving shaft 19.

The downwardly extended end portion of the fixed contactor (not shown) of the vacuum interrupter 2 or the extended member made of conductor coupled with the fixed contactor is coupled with 3-phase terminals 40 towards the power source or the load through a conductive member 50.

Reference number 60 denotes a support plate for supporting the second movable contactor 9 and the ground terminals 16.

The operation of the gas insulating switchgear constructed as described above will now be explained with reference to FIG. 1.

As shown in the drawing, the position the driving arm 32 is rotated by 23° counterclockwise from the line drawn passing the center of the driving shaft 19 and vertical to the bottom of the housing 1 indicates a switch-ON position. Further rotation of the driving arm 32 clockwise from this position is stopped by the lower limit pin 33.

In this switch-ON state, the link 20 is pulled downwardly and the guide member 13 coupled with the link 20 is rotated clockwise so that the pressure pin 11 is positioned at the end of the left leg portion of the guide aperture 12. At this time, the switching pin 15 is upwardly pressurized by the plate spring 7 so as to contact the fixed contactor 6.

Also, at this time, though not shown in FIG. 1, the movable contactor 8 and the fixed contactor within the vacuum interrupter 2 contact each other. Then, assuming that the terminal 40 is a power source terminal and the terminal 40 is a load terminal, current flows from the power source terminal 4 through the bus bar 5, the fixed contactor 6, the switching pin 15, the blade 14, the vacuum interrupter 2, and the conductive member 50 to the load terminal 40.

Meanwhile, in case that the driving shaft 19 is rotated by 90° counterclockwise manually or automatically, the driving arm 32 coaxially coupled with the driving shaft 19 is also rotated by 90° counterclockwise. At this time, the link 20 of which the lower portion is coupled with the driving arm 32 move upwardly, and the guide member 13 is rotated by 45° counterclockwise owing to the pressing force by the link 20. Also, the blade 14 is rotated by 45° counterclockwise.

Accordingly, the switching pin 15 is released from the fixed contactor 6 and the plate spring 7 and the current flow is cut off. At this time, the pressure pin 11 is positioned at the central portion in the lengthy direction of the guide aperture 12 that has roughly a channel form. Accordingly, the pressure pin 11 is raised as high as the length of the leg of the guide hone 12.

Subsequently, the movable contactor (reference numeral 8 of FIG. 3) of the vacuum interrupter 2 that has been downwardly pressed by the pressure pin 11 is raised to be separated from the fixed contactor (reference numeral 8*a* of FIG. 3) of the vacuum interrupter 2. And thus, the current flow is doubly cut off as the second switching means is also switched off.

Accordingly, the vacuum interrupter 2, that is, the first switching means, and the fixed contactor 6 and the movable contactor 9, that is, the second switching means, share the high voltage electricity generated when the circuit is broken, so that the rated insulation breakage voltage level of the vacuum interrupter becomes lower than that of the conventional art in which the current flow is cut off and the arc is extinguished only by means of the vacuum interrupter. Thus, there is no need to employ such an expensive vacuum interrupter having a high rated insulation breakage voltage level, and thus, the expense incurred to fabricate the gas insulating switchgear can be reduced.

Meanwhile, in case that the driving shaft 19 is further rotated by 90° counterclockwise from the switch-OFF position manually or automatically (that is, in case that the driving shaft 19 is rotated by total 180° from the switch-ON position counterclockwise), the link 20 is further raised from the switch-OFF position.

Then, the guide member 13 is additionally rotated by 45° counterclockwise from the switch-OFF position (that is, it is rotated by total 90° counterclockwise from the switch-ON position).

At this time, the pressure pin 11 is positioned at the right end portion of the guide aperture 12 on the figure, and thus, the pressure pin 11 is pressurized by the guide member 13 as long as the leg of the guide aperture 12 and then lowered down.

As the pressure pin 11 is lowered down, the movable contactor (reference numeral 8 of FIG. 3) of the vacuum interrupter 2 is pressed down to contact the fixed contactor (reference numeral 8*a* of FIG. 3) within the vacuum interrupter 2.

Also, at this time, as the switching pin 15 contacts the ground terminal 16, the movable contactor 9 and the movable contactor 8 and the fixed contactor 8*a* within the vacuum interrupter 2 are grounded.

Accordingly, the current remaining at the movable contactor 9, the movable contactor 8 and the fixed contactor 8*a* within the vacuum interrupter 2 flows to the ground.

Therefore, in case of cable branching of the load and/or the power source, cable repairing or cable checking, as described above, by grounding the second switching means of the switchgear, the worker can be protected from any possible accident of electric shock and safe work can be guaranteed.

Figure 2:
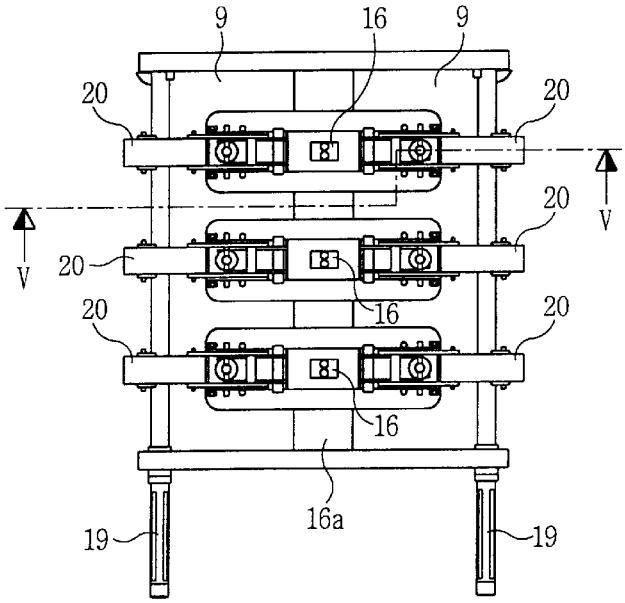
FIG. 2 is a plan view illustrating major parts of FIG. 1 in accordance with the present invention.

FIG. 2 is a plan view illustrating major parts of FIG. 1 in accordance with the present invention.

As shown in the drawing, in case where the switchgear of the present invention is connected with the three-phase AC power source and load for use, the actuator means including the second movable contactor 9 and the link 20 may be installed by two sets with three ones.

The two driving shafts 19 are respectively installed at each set of the second movable contactor 9 and the actuator means. The end portion of driving shaft 19 that is protruded from the housing 1 has a plurality of angled plane portions so that it can be firmly coupled with a means, such as a handle, to deliver a driving force.

Three ground terminals 16 are prepared to correspond to the two facing movable contactors 9.

One rectangular column 16*a* is installed for the second movable contactor 9 and the two sets of actuator means.

Reference numeral 60 is a support plate to support the second movable contactor 9 and the ground terminals 16.

With the construction as shown in FIG. 2 as stated above, when the driving shaft 19 is rotated clockwise or counterclockwise, a set of second movable contactor 9 and the actuator means is concurrently operated.

Figure 3:
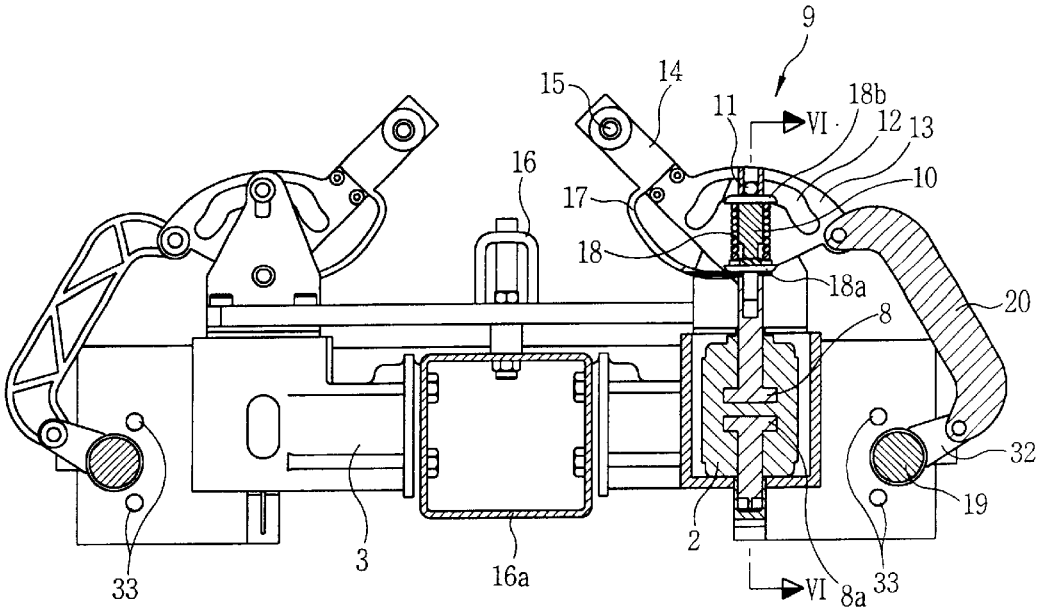
FIG. 3 is an. enlarged sectional view taken along line V—V of FIG. 2 in accordance with the present invention.

FIG. 3 is an enlarged sectional view taken along line V—V of FIG. 2 in accordance with the present invention.

The mutual connections between actuator unit, the second movable contactor and the vacuum interrupter and their operations will now be described.

A supporter member 10 has one end portion coupled with the movable contactor 8 and the other end portion extended to the guide aperture 12. The supporter member 10 can be linearly moved together with the movable contactor 8.

The pressure pin 11 is installed to penetrate the other end portion of the supporter member 10 and the guide aperture 12. When the guide member 13 of the movable contactor 9 is rotated, the pressure pin 11 is pressurized in the vertical direction by the guide member 13 having the guide aperture, so that the rotational force of the guide member 13 is converted to a linear movement force and provided to the supporter member 10.

A first spring 18 is a coil spring which surrounds the outer circumferential surface of the supporter member 10 to pressurize the pressure pin 11 upwardly.

A pair of spring seats 18*a* and 18*b* are provided to support the both end portion of the first spring 18 in the lengthy direction.

A second spring 17 is a plate spring which is elastically supported by the lower spring seat 18*a*. The upper end of the second spring 17 is coupled or integrally connected with the blade 14, and the lower end thereof is supported by the lower spring seat 18*a* upwardly.

The rectangular column 16*a* is a hollow pipe with its section in a rectangular shape. The rectangular column 16*a*, made of a conductor, connects and supports a conductor in a bolt shape that penetrates the ground terminal 16 and is downwardly extended, as well as supporting the insulating housing 3 by means of the bolt that penetrates the rectangular column 16*a* and inserted into the insulating housing 3.

Descriptions for the same elements of FIG. 3 as in FIGS. 1 and 2 are omitted.

The second switching means, the first switching means within the vacuum interrupter 2 and the actuator means for driving the first and the second switching means will not be described.

First, as shown in FIG. 1, the position that the right driving arm 32 is rotated by 23° counterclockwise on the basis of the line which is vertical to the bottom of the housing 1 and passes the center of the driving shaft 19 is the switch-ON position. Further rotation of the driving arm 32 clockwise from this position is stopped by the lower limit pin 33.

In this switch-ON state, the link 20 of which lower portion is coupled with the driving arm 32 by a pin is pulled downwardly and the guide member 13 coupled with the upper end portion of the link 20 is rotated clockwise, so that the pressure pin 11 is positioned at the end of the left leg portion of the guide aperture 12.

Then, the pressure pin 11 is pressed downwardly by the guide member 13, according to which the upper spring sheet 18*b* supporting the bottom surface of the pressure pin 11 is pressed downwardly, and thus, the first spring 18 and the supporter member 10 are pressed downwardly by the upper spring sheet 18*b*. Therefore, the movable contactor 8 within the vacuum interrupter 2 coupled with the lower end portion of the supporter member 10 is pressed downwardly, so that the movable contactor 8 contacts the fixed contactor 8*a*.

Meanwhile, when the driving shaft 19 is rotated by 90° counterclockwise manually or automatically, the driving arm 32 coaxially coupled with the driving shaft 19 is also rotated by 90° counterclockwise. At this time, the link 20 of which lower end portion is coupled with the driving arm 32 is moved upwardly, and the guide member 13 is rotated by 45° counterclockwise owing to the pressing force by the link 20. Also, the blade 14 and the switching pin 15 are rotated by 45° counterclockwise. At this time, the pressure pin 11 is positioned at the central portion in the lengthy direction of the guide aperture 12 that has roughly a channel form. Accordingly, the pressure pin 11 is raised as high as the length of the leg of the guide hole 12.

At this time, the supporter member 10 is also raised due to the upwardly pressing lower spring sheet 18*a*. Thus, the movable contactor 8 coupled with the lower end portion of the supporter member 10 is separated from the fixed contactor 8*a* and raised up, so that the circuit is opened.

Meanwhile, in the case that the driving shaft 19 is further rotated by 90° counterclockwise from the switch-Off position manually or automatically (that is, in case that the driving shaft 19 is rotated by total 180° from the switch-ON position counterclockwise), the driving arm 32 coaxially coupled with the driving shaft 19 is also further rotated by 90°. Then, the link 20 of which lower end portion is coupled with the driving arm 32 is further raised up from the switch-OFF position.

Then, the guide member 13 is additionally rotated by 45° counterclockwise from the switch-OFF position (that is, it is rotated by total 90° counterclockwise from the switch-ON position).

At this time, the pressure pin 11 is positioned at the right end portion of the guide aperture 12 on the figure, and thus, the pressure pin 11 is pressurized by the guide member 13 as long as the leg of the guide aperture 12 and then lowered down.

Subsequently, as the pressure pin 11 is lowered down, it presses downwardly the upper spring sheet 18*b* that supports the bottom surface of the pressure pin 11, and the upper spring sheet 18*b* presses downwardly the first spring 18 and the supporter member 10.

Accordingly, the movable contactor 8 within the vacuum interrupter 2 coupled with the lower end portion of the supporter member 10 is pressed downwardly, so as to contact the fixed contactor 8*a*.

At this time, the switching pin 15 contacts the grounding terminal 16, and the movable contactor 9 and the movable contactor 8 and the fixed contactor 8*a* within the vacuum interrupter 2 are grounded. Accordingly, the current remaining at the movable contactor 9 and the movable contactor 8 and the fixed contactor 8*a* within the vacuum interrupter 2 flows to the ground.

Figure 4:
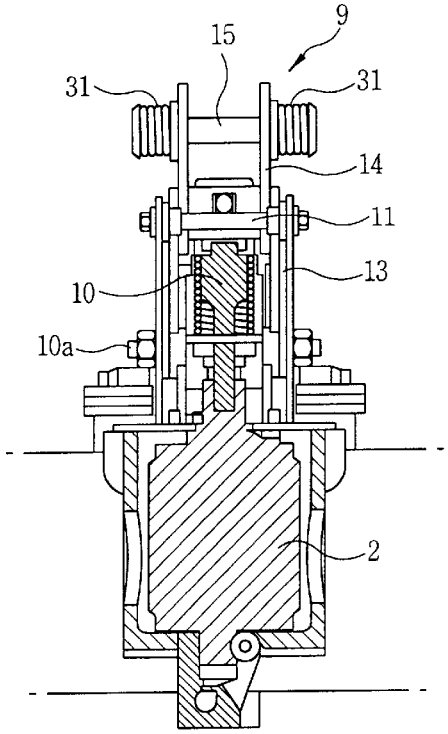
FIG. 4 is an enlarged sectional view taken along line VI—VI of FIG. 3 in accordance with the present invention.

FIG. 4 is an enlarged sectional view taken along line VI—VI of FIG. 3 in accordance with the present invention, which illustrates the constructions of the movable contactor 9 of the second switching means and the vacuum interrupter 2 and their mutual connections for easy understanding.

A pair of guide members 13 are installed spaced apart at a predetermined distance.

A pair of blade members 14 are installed spaced apart at a predetermined distance, facing to each other, of which lower portions are attached onto the inner wall of the guide members 13.

A pressure pin 11 is disposed to penetrate the pair of guide members 13 and the pair of blades member 14.

The switching pin 15 is installed to penetrate the upper portion of the blade members 14. A pair of coil springs 31 is disposed at both end portions of the switching pin 15 and at the upper portions of both blade members 14.

A pair of coil springs 31 serves to maintain the distance between the blade members 14, that is, the length of the exposed switching pin 15. Both end portions of the switching pin 15 have a larger diameter than other portions so that it serves as a spring sheet supporting the coil spring 31 along with the both outer walls of the blade members 14.

Reference numeral 2 denotes the vacuum interrupter and 9 denotes the movable contactor as described above.

Figure 5:
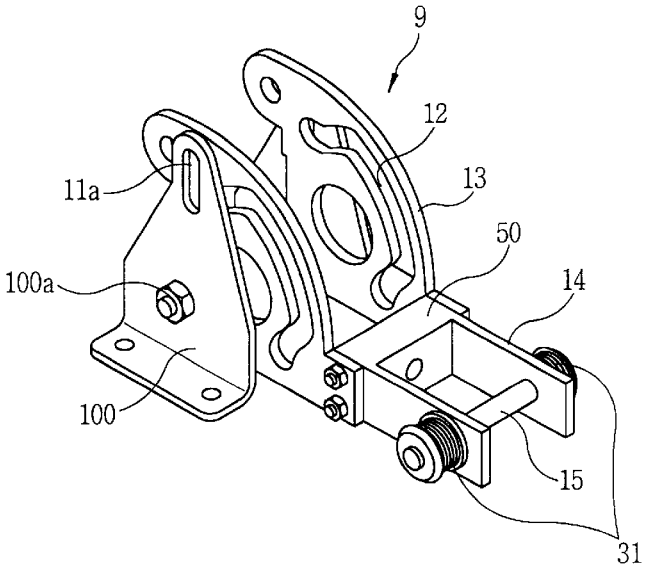
FIG. 5 is a perspective view of a second movable contactor of FIG. 3 in accordance with the present invention.

FIG. 5 is a perspective view of a second movable contactor of FIG. 3 in accordance with the present invention.

As shown in the drawing, the movable contactor 9 includes a pair of plate-shaped guide members 13 which are installed spaced apart, facing each other. Each guide member 13 has a channel-type guide aperture. The pair of guide members 13 are coupled with the pair of blades 14. In detail, a spacer 50 is installed between the pair of blades 14, and a coupling member such as a bolt penetrates the both guide members 13 and the both blades 14 and is inserted into the space 50, thereby coupling the guide members 13 and the blades 14.

A bracket 100, which is shown by one for illustration's convenience, is installed at both adjacent portions of outer sides of the guide members 13. A central shaft 100*a*, which becomes a rotational center of the guide member 13, extendedly penetrates the central portion of one bracket, the central portions of the both guide members 13 and the central portion of the other bracket.

In order to support the both end portions of the pressure pin 11 and allow a limitative vertical movement for the press pin 11, a vertical aperture 11*a* is provided at the upper portion of each bracket 100.

Figure 6:
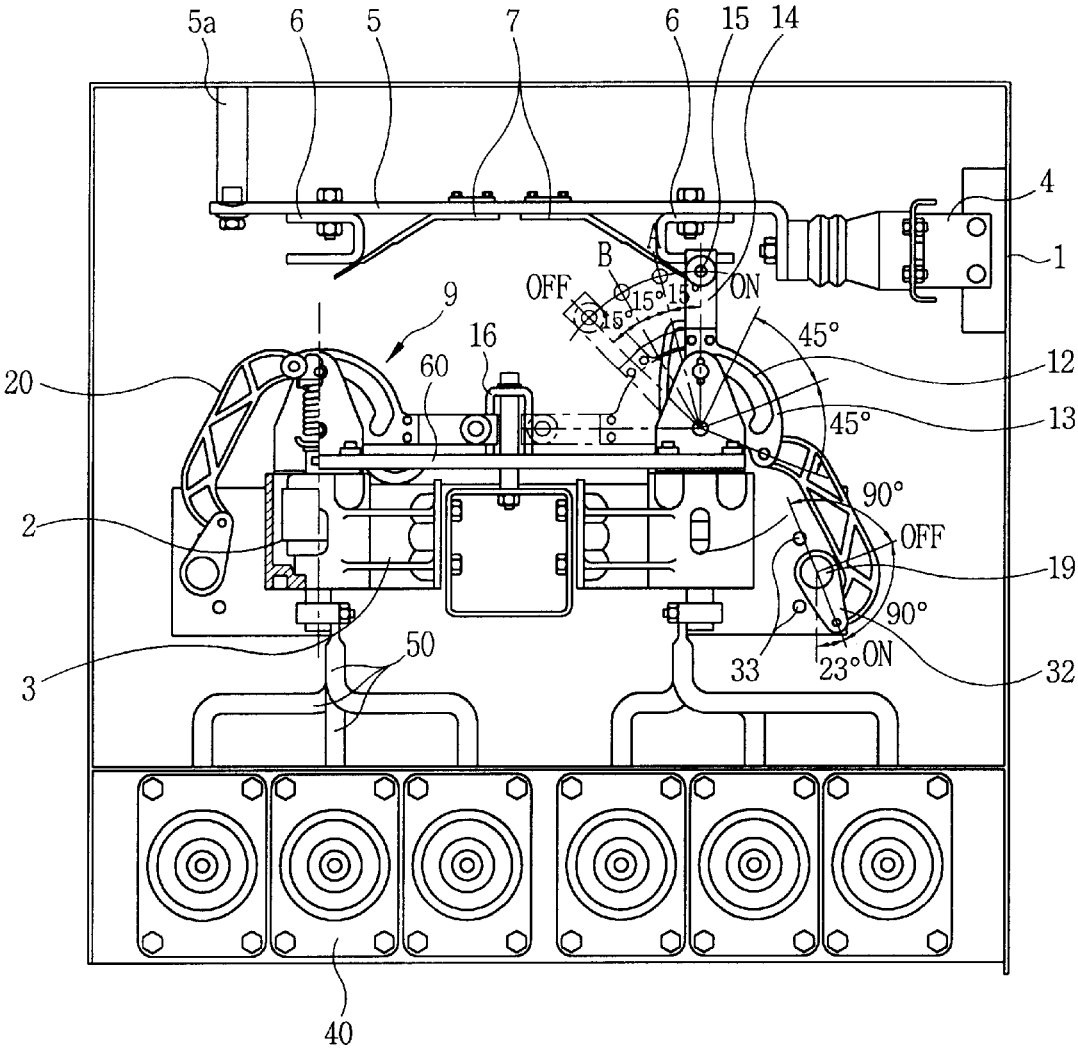
FIG. 6 is a front view illustrating a state that a second switching means of a gas insulating switchgear is ON in accordance with the present invention.
Figure 7:
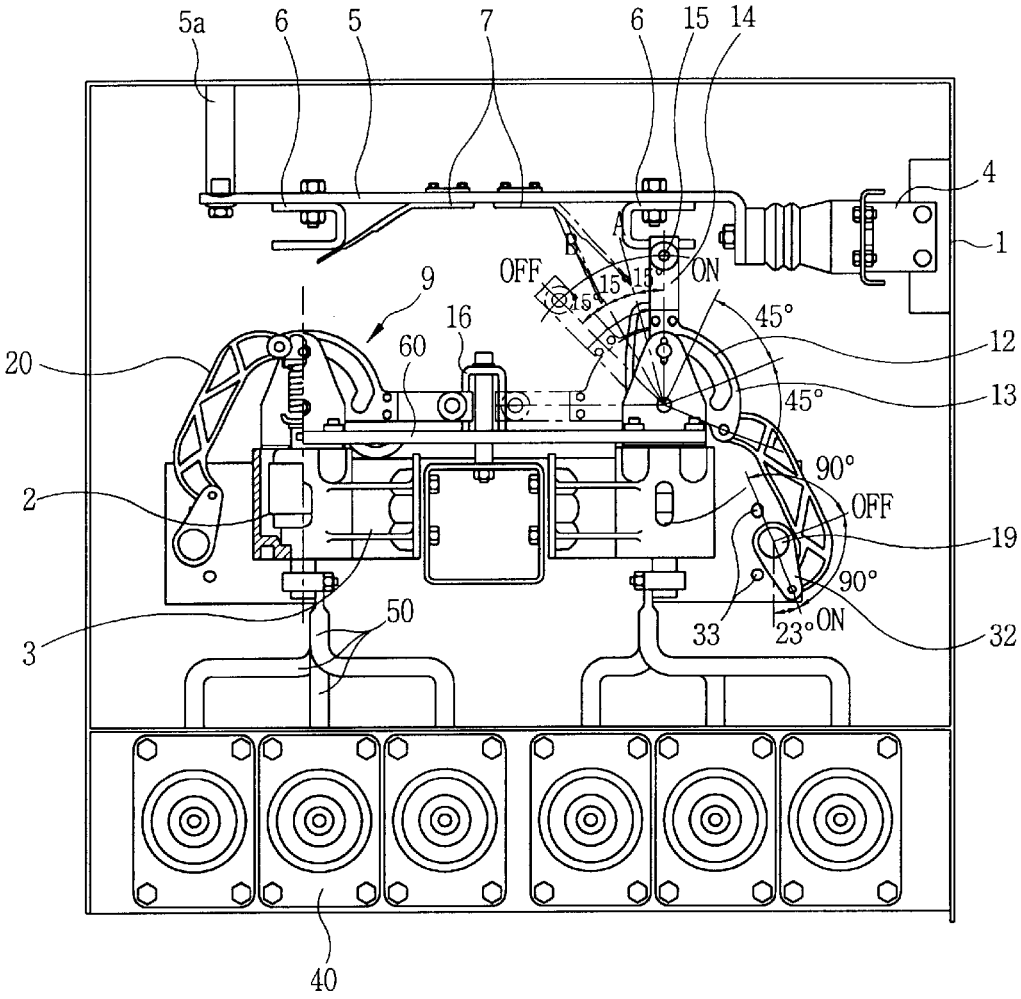
FIG. 7 is a front view illustrating a state that a second switching means of a gas insulating switchgear is OFF in accordance with the present invention.

FIG. 6 is a front view illustrating a state that a second switching means of a gas insulating switchgear is ON in accordance with the present invention; and FIG. 7 is a front view illustrating a state that a second switching means of a gas insulating switchgear is OFF in accordance with the present invention.

The operation of the gas insulating switchgear will now be described by status variations with reference to FIG. 7.

First, the operation of ON→OFF is as follows.

When the driving shaft 19 of which one end portion is outwardly exposed is rotated counterclockwise, that is, an opening direction, the driving arm 32 coaxially coupled with the driving shaft 19 is rotated in the same direction.

As the driving arm 32 is rotated in the opening direction, the link 20 of which one end portion is coupled with the free end portion of the driving arm 32 in a manner that it can be moved relatively, and the guide member 13 of the movable contactor 9 coupled with the other end portion of the link 20 is rotated counterclockwise, that is, the opening direction, thereby performing the opening operation.

With reference to FIG. 6, when the driving arm 32 is rotated by as much as the point of 30° with the whole rotation angle of 90° for its ON→OFF operation, the guide member 13 is rotated by 15°, one third of the whole rotation angle of 45° for its ON→OFF operation. At this time, the blade 14 and the switching pin 15 are rotated by 15°, one third of the whole rotation angle of 45° for its ON→OFF operation.

Then, the movable contactor 8, which is rotated according to the rotation of the guide member 13 and moved along the up/down direction, is separated from the fixed contactor 8*a* and moved away by as far as one fourth of the total stroke.

Generally, when the vacuum interrupter 2 is opened, the arc is extinguished at a point of about 30% of the opening stroke, during which the switching pin 15 is positioned at the 'A' point of FIG. 7 in a state of contacting the plate spring 7 of the bus bar 5 and being conductive, so that no arc is generated between the switching pin 15 and the fixed terminal 6.

And, the switching pin 15 and the plate spring 7 are separated and spaced apart between the points 'A' and 'B', so that electrical insulating is completed between the blade 14 and the fixed terminal 6, and between the movable contactor 8 and the fixed contactor 8*a*.

Namely, the arc extinguishing is performed within the vacuum interrupter 2, and as for the insulation between the power and the load, since the insulation between (vacuum insulation) the fixed contactor 8*a* and the movable contactor 8 of the vacuum interrupter 2 and the insulation (SF6 gas insulation) between the switching pin 15 and the fixed terminal 6 are added, so that more than the total 125 KV of rated insulation breakage voltage can be insulated, which is higher than that of only the vacuum interrupter 2.

The operation of OFF→ON is as follows.

When the driving shaft 19 is rotated clockwise, that is, the switch-ON direction, the driving arm 32 coaxially coupled with the driving shaft 19 is accordingly rotated in the same direction.

As the driving arm 32 is rotated clockwise, the line 20 coupled with the driving arm 32 is lowered down, and the guide member 13 is rotated clockwise, thereby performing the switch-ON operation.

As shown in FIG. 6, when the driving arm 32 is initially rotated by 60° clockwise with the total rotation angle 90° for the OFF→ON operation, the guide member 13 is rotated by 30°, two thirds of the total rotation angle 45° for the OFF→ON operation and the movable contactor 8 is moved by as far as two thirds of the total stroke in the direction approaching the fixed contactor 8*a* by virtue of the blade member 13.

Generally, when the switch is ON, the arc is extinguished in the vacuum interrupter 2 at a point of about 30% of the switch-ON stroke of the movable contactor 8, during which the switching pin 15 is already positioned at the 'A' point of FIG. 6 which contacts the fixed contactor 6, thereby being mutually conducted.

Accordingly, arc extinguishing operation is performed only in the vacuum interrupter 2, and after the switching pin 15 and the fixed contactor 6 are conducted, the movable contactor 8 and the fixed contactor 8*a* are conducted.

The operation of OFF® grounding operation is as follows.

When the driving shaft 19 is rotated counterclockwise, that is, a grounding direction, the driving arm 32 coaxially coupled with the driving shaft 19 is rotated counterclockwise, according to which the line 20 coupled with the driving arm 32 is raised up, and then, the guide member 13 is rotated counterclockwise, thereby performing grounding operation.

In the grounding operation, the operations of the movable contactor 9 and the vacuum interrupter 2 are the same as in the above-described OFF® ON operation.

When the driving shaft 19 is rotated by 60° counterclockwise from the opening position, that is, two-thirds of the total rotation angle 90° for the OFF→searching operation, the guide member 13 is rotated by 30° counterclockwise over the total rotation angle 45° for the OFF→earthing operation.

Simultaneously, the blade 14 and the switching pin 15 are also rotated by 30° counterclockwise over the total rotation angle 45° for the OFF→earthing operation.

Accordingly, the switching pin 15 contacts the ground terminal 16, so that the blade 14 and the earthing terminal 16 are conducted each other, between which no arc is generated.

At this time, the movable contactor 8 is moved by as far as two thirds of the total stroke to be adjacent to the fixed contactor 8*a* by the guide member 13. And, as aforementioned, the vacuum interrupter 2 starts arc extinguishing at the point of 30% of the stroke of the movable contactor in grounding operation, and after the blade 14 and the ground terminal 16 are conducted (grounded), the movable contactor 8 and the fixed contactor 8*a* finish arc extinguishing and become grounded.

The operation of earthing→OFF is as follows.

When the driving shaft 19 is rotated clockwise, that is, the operating direction from the grounding, the driving arm 32 coaxially coupled with the driving shaft 19 is rotated clockwise, according to which the link 20 is lowered down and the guide member 13, the blade 14 and the switching pin 15 are rotated clockwise, thereby performing opening operation.

The general inter-working operation of the movable contactor 9 and the vacuum interrupter 2 is similar to that of the ON→OFF operation.

That is, as the pressure pin 11 is raised up, the movable contactor 8, which is moved up/down direction as being cooperatively moved by the rotation of the guide member 13, is separated from the fixed contactor 8*a*, so that opening operation that the circuit is cut off (broken) is accomplished.

As so far described, according to the gas insulating switch gear of the present invention, in case that the gas insulating switch gear is applied to a switch gear having a rated insulating voltage level of 125 KV, the switch gear can have a rated insulating breakage voltage of more than 125 KV (150 KV) by using the vacuum interrupter 2 and the second switching means each having the rated insulating breakage voltage level of about 75 KV.

That is, since the arc extinguishing is performed only in the vacuum interrupter 2, when the insulation (vacuum insulation) between the movable contactor 8 and the fixed contactor 8*a* of the vacuum interrupter 2 and the insulation history (such as SF6 gas insulation) between the switching pin 15 of the second movable contactor 9 and the second fixed contactor 6 are added, a rated insulating breakage voltage higher than 125 KV can be obtained.

In addition, by adding the ground function using the ground terminal 16, a worker can do a job such as a power source or load cable installation, cable maintenance and repairing in a more safe circumstance.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A gas insulating switchgear comprising:

a housing for holding and sealing an electric insulating gas;

a power source terminal for being electrically connected with a power source outside the housing;

a load terminal for being electrically connected with a load outside the housing;

a ground terminal;

a vacuum interrupter installed in the housing and having a first fixed contactor and a first movable contactor, for electrically connecting or disconnecting the power source terminal and the load terminal;

a second fixed contactor electrically connected with the power source terminal or with the load terminal;

a second movable contactor rotatably movable to one of a connecting position at which the second movable contactor contacts the second fixed contactor or a disconnecting position at which the second movable contactor is separated from the second fixed contactor or a ground position at which the second movable contactor contacts the ground terminal; and an actuator means for providing the first movable contactor and the second movable contactor with a driving force for movement of the first movable contactor and the second movable contactor, said actuator means including:

a rotatable driving shaft;

a link means for transmitting a rotation torque of the driving shaft to the second movable contactor; and a converting means for converting the rotation of the second movable contactor to a linear driving force and applying it to the first movable contactor;

said converting means including:

a second movable contactor having a guide aperture;

a supporter member of which one end portion is coupled with the first movable contactor and another end portion of which is extended toward the guide aperture, for being linearly moved along with the first movable supporter member; and a pressure pin installed to penetrate the other end portion of the supporter member and the guide aperture, for being pressed in the vertical direction by the second movable contactor having the guide aperture when the second movable contactor is rotated, to convert the rotational force of the second movable contactor into a linear movement force and apply it to the supporter member;

said converting means further including:

a first spring for pressing the pressure pin upwardly;

a pair of spring seats for supporting the both end portions of the first spring; and a second spring for elastically supporting the lower spring seat of the pair of spring seats.

* * * * *